United States Patent [19]

Wefels

[11] Patent Number: 4,628,652

[45] Date of Patent: Dec. 16, 1986

[54] GLASS BRICK

[75] Inventor: Peter Wefels, Gelsenkirchen, Fed. Rep. of Germany

[73] Assignee: VEGLA, Vereinigte Glaswerke GmbH, Aachen, Fed. Rep. of Germany

[21] Appl. No.: 527,176

[22] Filed: Aug. 26, 1983

[30] Foreign Application Priority Data

Sep. 9, 1982 [DE] Fed. Rep. of Germany ..... 3233470
May 2, 1983 [DE] Fed. Rep. of Germany ..... 3315942

[51] Int. Cl.[4] ..... E04C 1/42

[52] U.S. Cl. ..... 52/306; 52/227; 52/438; 52/562; 52/593

[58] Field of Search ..... 52/204, 217, 235, 293, 52/306, 307, 308, 309.1, 309.3, 309.13, 309.14, 421, 427, 436–439, 561, 562, 568–572, 578, 589–604, 608–612, 741, 742, 743, 745, 746, 747, 749, 750, 476, 477; 446/105, 108, 111, 115, 116, 125, 127

[56] References Cited

U.S. PATENT DOCUMENTS

| | | | |
|---|---|---|---|
| 1,028,578 | 6/1912 | Lund | 52/227 |
| 1,457,437 | 6/1923 | Kelly et al. | 52/592 |
| 2,176,213 | 10/1939 | Duffy | 52/475 |
| 2,241,169 | 5/1941 | Yokes | 52/228 |
| 2,877,506 | 3/1959 | Almoslino | 52/227 |
| 3,374,917 | 3/1968 | Troy | 52/589 |
| 3,534,518 | 10/1970 | Zagray | 52/595 |
| 3,925,950 | 12/1975 | von der Ley | 52/589 |
| 4,008,931 | 2/1977 | Kennedy, Jr. et al. | 52/591 |
| 4,031,678 | 6/1977 | Schuring | 52/589 |
| 4,058,943 | 11/1977 | Sturgill | 52/477 |
| 4,060,952 | 12/1977 | Hernandez | 52/593 |
| 4,428,174 | 1/1984 | Grady, II | 52/227 |

FOREIGN PATENT DOCUMENTS

| | | | |
|---|---|---|---|
| 107776 | 7/1939 | Australia | 52/308 |
| 2263127 | 7/1974 | Fed. Rep. of Germany . | |
| 2613695 | 10/1977 | Fed. Rep. of Germany | 52/308 |
| 2926836 | 1/1980 | Fed. Rep. of Germany | 52/593 |
| 1394241 | 2/1965 | France | 52/308 |
| 488640 | 7/1938 | United Kingdom | 52/594 |

OTHER PUBLICATIONS

Architectural Forum, Revere Interlocking Metal Members, Sep. 1940, p. 69.

*Primary Examiner*—John E. Murtagh
*Assistant Examiner*—Andrew Joseph Rudy
*Attorney, Agent, or Firm*—Marmorek, Guttman & Rubenstein

[57] ABSTRACT

A glass modular construction block is provided with a form-fitting frame of an integral foam material, and wherein the frame on the impact surface is provided with projections and recesses, which permit a firm plug-in connection. Along the narrow sides, the frame includes sealing projections. The space between the sealing projection serves for the insertion of reinforcement bars made of flat sections, which are provided with through-going openings for the plug-in projections. Setting of the glass modular construction blocks is accomplished without any additional adhesive means, so that a wall or wall portions constructed from such glass modular construction blocks can be disassembled, and so that the glass modular construction blocks are reusable.

14 Claims, 8 Drawing Figures

GLASS BRICK'

BACKGROUND OF THE INVENTION

The invention relates to a glass modular construction block with a support frame of synthetic material, which is provided on its periphery with projections and recesses for setting of the glass modular construction blocks for a proper fit thereof.

Glass modular construction blocks of this type are known, in which the support frame therefor is provided with notches or resilient recesses or projections, which engage one another during construction of a wall portion made of such glass modular construction walls, and which serve as centering means (DEAS No. 2263127). But the frame can also be implemented so that it is provided with lateral projections, which extend up to the glass rim of an adjoining glass modular construction block, while the frame of the adjoining glass modular construction block is reset from the rim by the size of these projections The known framed glass modular construction blocks are glued to one another at their abutment surfaces by interposing of an adhesive. The projections and recesses engaging one another do not hold the glass modular construction blocks, with which they coact, to one another, but merely prevent a mutual shifting in one direction. Until the setting of the adhesive, a mutual displacement of the glass modular construction blocks in both other directions is therefore possible, which can no longer be corrected following setting of the adhesive

SUMMARY OF THE INVENTION

It is an object of the invention to further develop a glass modular construction block of the above-described kind, so that the construction of a wall portion from such glass modular construction blocks is further simplified and facilitated. Here, in particular, the frame should be so formed, that the glass modular construction blocks can be connected to one another so as to form a wall held firmly together without the interposition of any adhesive. The expansion joints of adjoining glass modular construction blocks should consequently provide a seal against any penetrating water, so that a wall constructed from glass modular construction elements of this type is suitable for construction of outer walls, as far as its mechanical stressability, as well as its sealing properties with respect to moisture are concerned.

This object is attained, according to the invention, by the peripheral surfaces of the frame being provided, on one hand, with three-dimensional projections and recesses which determine the mutual position of the construction elements in two spatial directions, and permit a firm plug-in connection, and by the peripheral surfaces being, on the other hand, provided on its narrow sides with frame-like carrier projections, and further by the frame consisting of synthetic material with a closed surface, and having a Shore-D hardness of 70 to 85.

By the inventive geometric formation of the peripheral surfaces, in connection with the particular material properties of the material of the frame, there results a pointed insignificant elastic deformation of the frame in the region of the mutually abutting frame-like projections taking over the pressure loading which ensures a reliable seal of the expansion joints with respect to any water-penetrating thereinto. That makes it possible to dispense with adhesive layers, and it ensures both the firm connection of the elements between one another, as well as a lasting seal against any penetrating water, by the shaping and material-selection of the frame. This results not only in a considerable simplification during setting, namely during construction of the wall portion, but also results in the wall portions later being able to be disassembled again at any time, and by the glass modular construction blocks being reusable at any time for the construction of a different wall portion without any difficulty.

BRIEF DESCRIPTION OF THE DRAWINGS

Further details and advantages of the invention can be ascertained from the dependent claims, and from the following description of various embodiment examples with the aid of the drawings in which:

Figure 1:
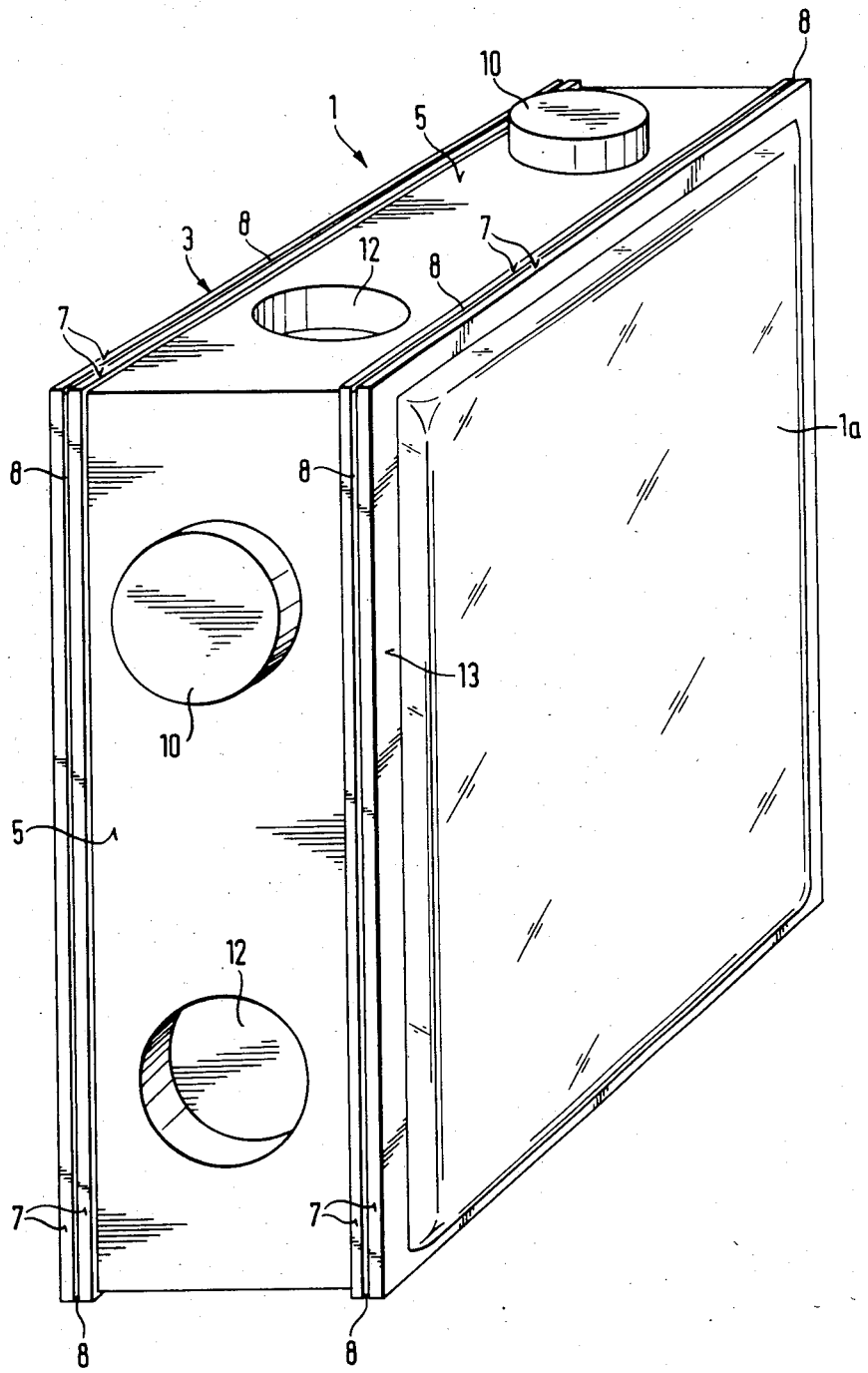
FIG. 1 is a first embodiment of the inventively formed glass modular construction block in a total perspective view.

The glass body 1 proper of the glass construction block consists of two half-elements 1*a* and 1*b* (FIG. 2), which are welded to one another, while forming a welding seam 2. Instead of welded glass modular construction blocks, glass construction blocks manufactured by other methods can, of course, also be used, and be provided with the inventive frame 3. Under certain circumstances, it is even possible to use two half-elements not yet connected with one another, instead of a complete glass modular construction block, and to provide these with a frame in a correct position with regard to one another, in which case the frame has the additional object, apart from the inventive function, to ensure the firm connection and sealability of the so-combined glass modular construction block. The frame 3 is disposed as a closed frame along the entire peripheral surface of the glass body 1. The outer dimensions of the frame 3 have tight dimensional tolerances, so that the surfaces coacting with one another abut one another tightly, and so that the connecting projections or recesses ensure a firm seal following assembly.

Manufacture of the frame 3 is accomplished, for example, in a known manner by the so-called "reaction-foam-casting-method" which is also known as the RIM method (The reaction-injection-molding). Here the synthetic material is sprayed in fluid form with an appropriately formed foaming tool on the peripheral surface of the glass element 1. The synthetic material hardens the forming tool, so that the finished and framed glass modular block can be removed from the forming tool.

Also, in case of adhesion of the synthetic material to the glass surface, an adhesion improver or "primer" tailored to the respective synthetic material can be employed, which is applied to the peripheral surface of the glass body prior to insertion of the glass body into the forming tool. Such adhesion improvers are available in commerce, and are selected in dependence of the synthetic material used for frame.

For a further improvement of adhesion of the frame 3 to the glass body 1, the peripheral surface 4 can be roughened to such an extent, or provided with a structure so that the surface in contact with the synthetic material of the frame is considerably larger than when in a smooth state. This desired enlargement of the glass surface is accomplished by an appropriate formation of the forming walls of the press moulds, by means of which the half-elements 1*a*, 1*b* are compressed. A sufficient enlargement of the glass surface can be obtained by corrugation, knobbling or other roughening of the wall of the compression tool.

Figure 2:
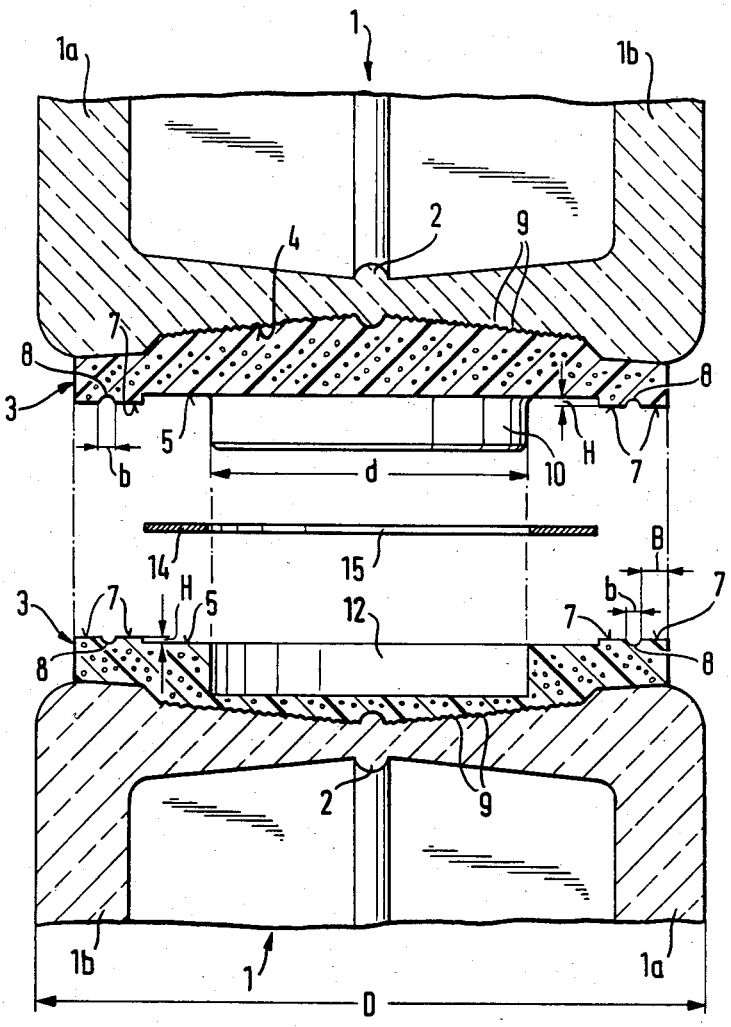
FIG. 2 represents a section in the region of the mutually coacting connecting elements of two glass modular construction elements according to FIG. 1.

The outer peripheral surface of the frame 3 consists, in the example shown in FIGS. 1 and 2, of a central plane surface 5, of connecting projections 10 projecting from the surface 5, of the connecting recesses 12 extending into the frame of the narrow sides 13, and of the ledge-like carrier projections 7 disposed along the narrow sides 13, and projecting from the surface 5. These projections 7 form the actual force-transmitting contact surfaces between the individual glass constructional blocks.

The projections 7 are separated from another by groove-like recesses 8. Each upper even limiting surface of the projections or rim 7 has a width of about 2 to 4 millimeters, and the groove-like recess 8 has a width b of about 1 to 3 millimeters, preferably about 2 millimeters. By this formation of the projections 7, a sealing with advantageous sealing properties is obtained in connection with the elastic deformability of the synthetic material constituting the frame. The groove-like recesses 8 of the glass modular blocks disposed next to one another in a wall portion constructed from these glass modular blocks, communicate with one another, and the vertically extending groove-like recesses 8 form to a certain extent groove-like hollow channels, through which any water that has penetrated the first sealing surface may run off, if necessary.

The connecting projections 10 have the form of circular cylinders. Their diameter d amounts to from about 80 millimeters to about 40 millimeters at a total thickness D of the glass modular construction block. The hollow cylindrically-shaped recesses 12 have similar dimensions.

Related to the flat bordering surface 5, the sealing projections 7 have a height H of, for example, 0.6 mm. During assembly of the glass modular construction block, there arises consequently between the flat bordering surfaces 5 a hollow space having a height of 1.2 millimeters. This hollow space serves for insertion of armored bands 14. The armored bands 14 are formed with punched holes 15 along predetermined distances determined by the projections 10 or the recesses 12, and they consist of a metal band of 1 millimeter thickness. Depending on the static demands, which are imposed on the wall portion, the armored bands 14 can consist of a metal suitable therefor, such, as for example, aluminum at small static demands, or a rare metal at very high static demands Between the armored bands 14 and the flat bordering surfaces 5, there arises a play of about 0.2 millimeters. The sealing projections 7 can be compressed by this measure in an extreme case, so that the sealing is further improved.

The frame 3 consists of an integral foam material, namely of a synthetic material with a non-foamed covering layer, and a foamed nucleus. Particularly suitable therefor is, for example, a hard polyurethane integral foam material having a form foamed raw density of 400 to 700 kg/m$^3$, having a bending E modulus according to DIN 53423 of 950 to 1100 MPa, at a pressure rigidity according to DIN 53421 at 10% compression of 10–18 MPa, a Shore-D hardness according to DIN 53505 of 70–85, and a linear heat expansion coefficient according to DIN 53132 of less than 100 m/m.K.10$^6$, at the respective raw density of 600 kg/m$^3$. In this integral foam material the properties of the compact covering layer assume a decisive role. This covering layer has, in addition to the closed surface, a significantly higher E modulus than the integral working material. The E modulus of the covering layer can assume values up to 2,000 MPa. The integral foam material of the Company Bayer, having the commercial name BAYDUR 651oF accomplishes the afore-named conditions in a satisfactory manner. This working material has a bending E-modulus of 1,050 MPa at a raw density of 600 kg/m$^3$, a pressure rigidity of 12 MPa, a Shore-D-hardness of 79, and a linear heat expansion coefficient of 90 m/m.K.10$^6$. A fluid propellant charge is added during mixture to the polyol- and isocyanate-components reacting with the polyurethane, so that the polyurethane, which arises by the reaction of the components, foams.

Instead of an integral foam material, also other synthetic materials, for example thermoplastic synthetic materials, can be used for the frame, to the extent that their material properties, particularly their resistance to pressure, and their elastic properties are comparable to the above-named integral foam materials.

The projections 10 and the resistors 12 for the plug-in-connections can be basically disposed on the periphery of the frame 3 in an arbitrary arrangement. For example, two oppositely disposed sides can be provided with the projections 10, and the other oppositely disposed sides can be provided with recesses 12. In lieu of the aforenoted arrangement, two bordering sides can be provided with respective projections and recesses, or, as has been shown in the embodiments illustrated, a projection 10 and recess 12 can alternate on each side of the peripheral surface.

Figure 3:
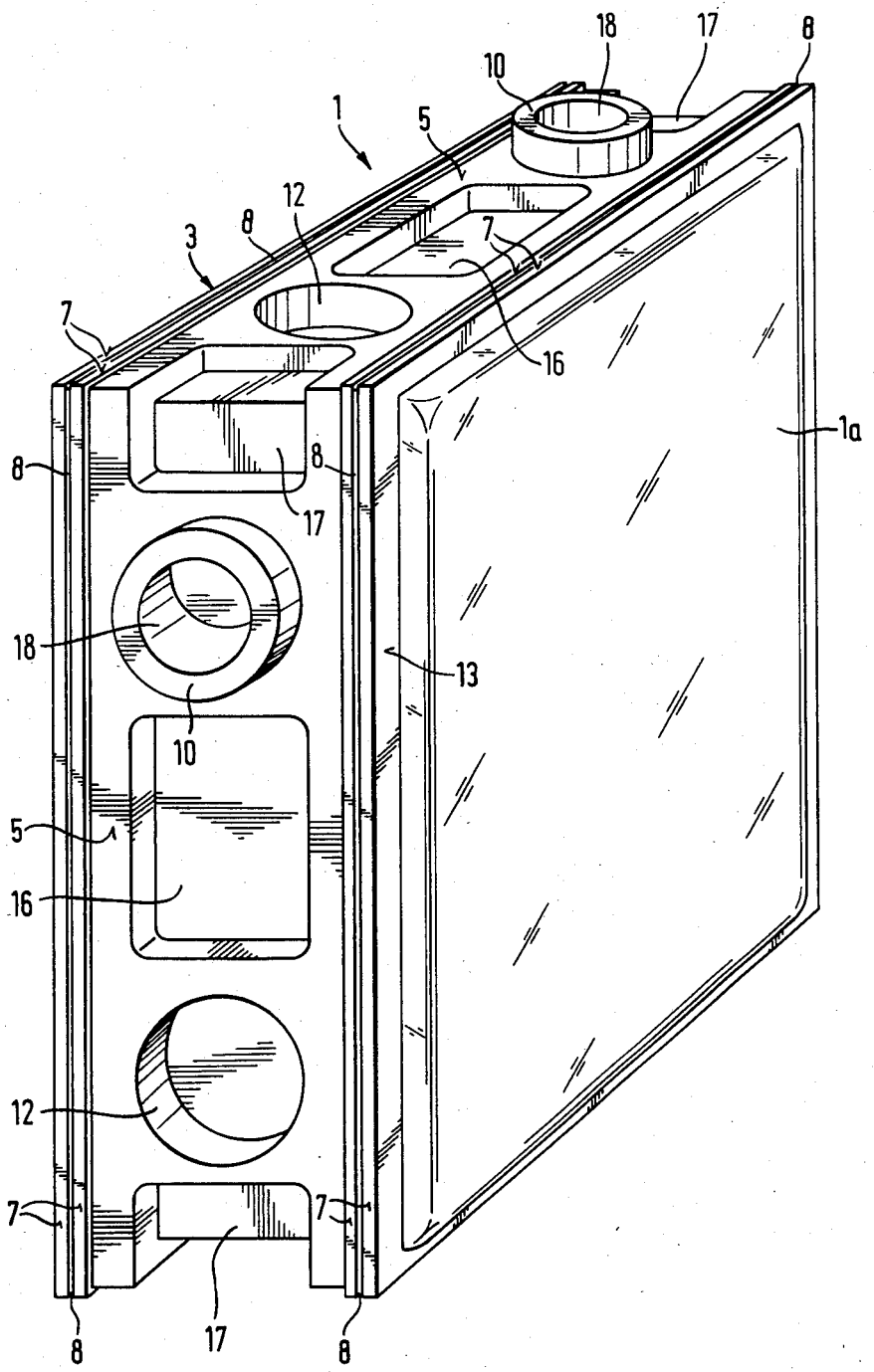
FIG. 3 is a second embodiment of the inventive glass modular construction block in a perspective view.

In the embodiment shown in FIG. 3, there are provided recesses 16, 17 and 18 on those locations which do not have any significance for the actual functioning of the frame 3, concerning their static properties, and concerning the sealing effectiveness of a wall portion made up of such glass modular construction blocks. The quantity of the synthetic material of the frame 3 is considerably reduced by the recesses 16, 17 and 18, which brings with it a cost advantage, which is particularly important, if the synthetic material used is relatively expensive.

Figure 4:
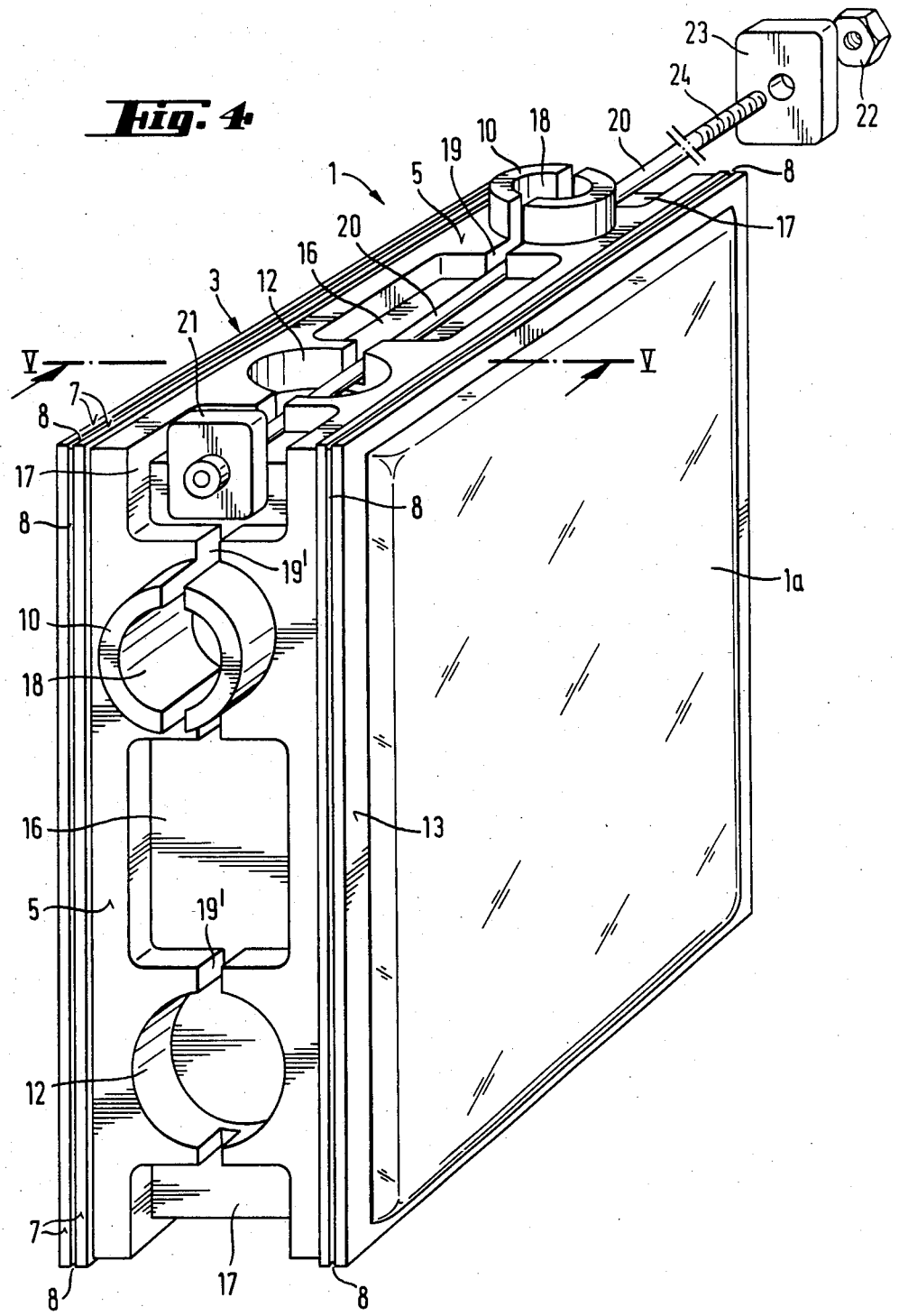
FIG. 4 is a further embodiment of an inventive glass modular construction block, also in perspective view.

The frame 3 of the glass modular construction block can further be provided, as can be seen in the above embodiment according to FIG. 4, in its center with longitudinal grooves 19 and 19', which extend to the floor of the recesses 16, 17 and 18. These longitudinal grooves 19 and 19' serve to receive a tension wire 20, made, for example, of a very strong noble steel. By means of such a tension wire 20, which is anchored to a construction block at the end of a series of glass modular construction blocks with the aid of a disk 21 disposed in a recess 17, and which engages another corresponding glass modular construction block at the other end of the series of the glass modular construction blocks, for example, with the aid of a threaded nut 22, of a disk 23, and of a thread 24 arranged at the end of the tension wire 20, the glass modular construction block can be tensioned within a wall portion with respect to one another. In this manner, the required pressure can be generated, which is necessary for a sealing connection. Complete wall portions can optionally be prefabricated with the aid of such tension wires 20, and these wall parts can be transported and installed at the building location as prefabricated parts. It is also possible to install such tension wires both in a horizontal direction, as well as in a vertical direction. In this case the horizontal longitudinal grooves 19 and the vertical longitudinal grooves 19' are arranged so as to be displaced with respect to one another away from the center, so that the horizontal tension wires and the vertical tension wires come to lie in two adjoining planes.

Connection of the glass modular construction blocks with the aid of such tension wires is particularly suitable for those cases, in which the glass modular construction blocks are not combined into that wall surfaces, but are combined, for example, into cylindrically curved wall surfaces. In such cases only the peripheral surfaces of the frame need be formed on one or several sides with the desired inclination, so that two bordering parts subtend an angle different from 180°. This method of mutual pretension with the aid of a tension wire also has the advantage that the required compression forces are generated exclusively in the wall portion itself, without the neighboring construction parts being tensioned.

Figure 5:
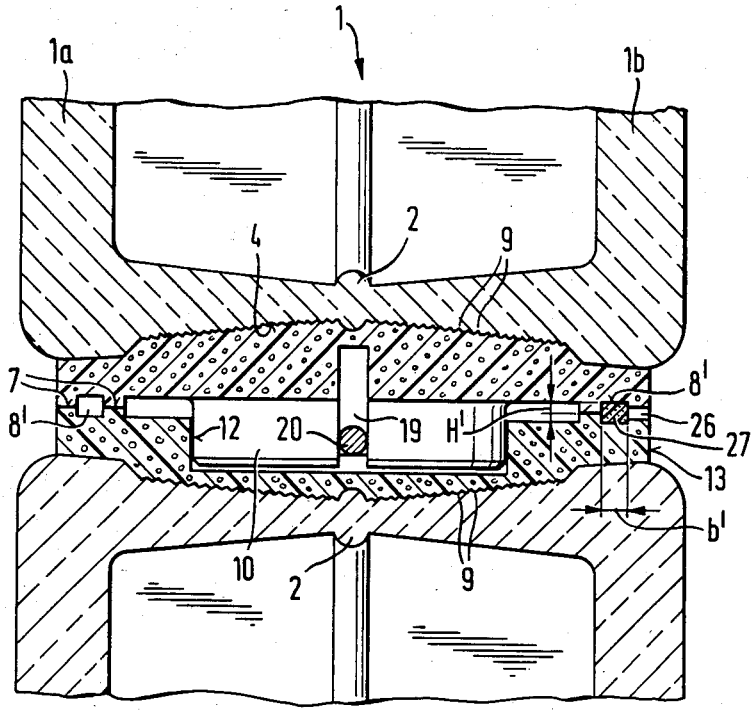
FIG. 5 is a cross-section along the line V—V of FIG. 4 in a transition region between two connected glass modular construction blocks.

In the section shown in FIG. 5, there will be recognized the tension wire 20 within the longitudinal groove 19. Furthermore, in this illustration there is shown a possibility, how an additional sealing can be obtained in a wall consisting of the inventive glass modular construction blocks, where particularly stringent demands are made concerning the water tightness For this purpose bores 26 extending up to the recess 8' are made at selected locations, for example in the center of the narrow sides 13, and in the contact plane formed by the projections 17, following installation of the wall portion. With the aid of a suitable injection mechanism provided with a hollow needle insertable into the bore 26, an injectable and permanently elastic sealing mass 27, for example, based on silicon, is injected under pressure into the bore 26. The sealing mass 27 flows through the longitudinal groove 8, while exerting pressure thereonto, and ensures a realiable additional sealing. It is, of course, sufficient if these additional sealing measures are only undertaken on that side of the wall portion, onto which moisture or water acts.

If such additional sealing is to be undertaken by injecting a sealing mass 27 into the groove 8', then it is recommended that the cross-section of the groove 8' be selected somewhat larger than that of the embodiment described with the aid of FIG. 2. In this case the width b' advantageously is about 3 mm, and the height H' about 1.5 mm.

Figure 6:
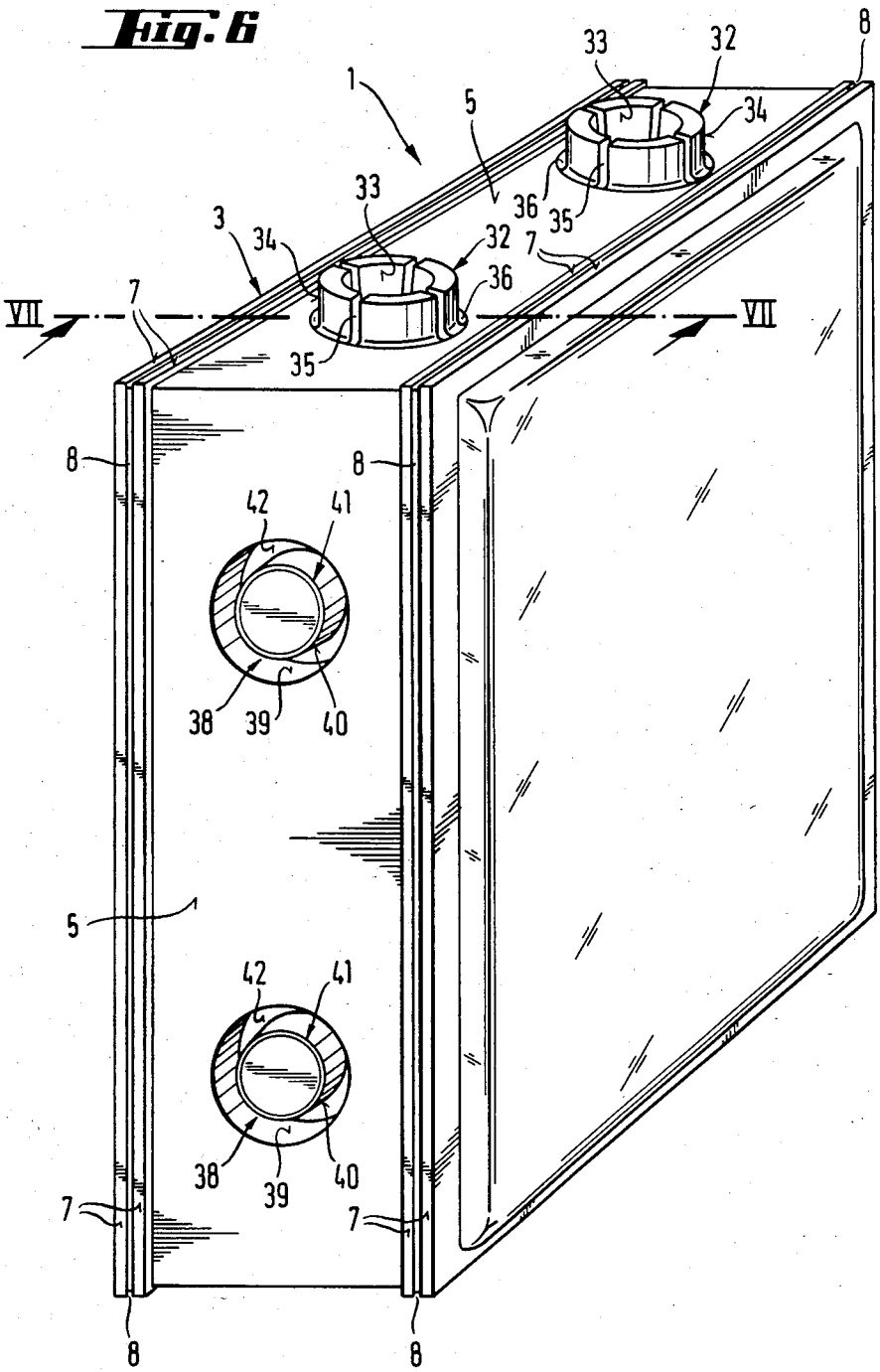
FIG. 6 is a further embodiment of an inventive glass modular construction block in perspective view.
Figure 7:
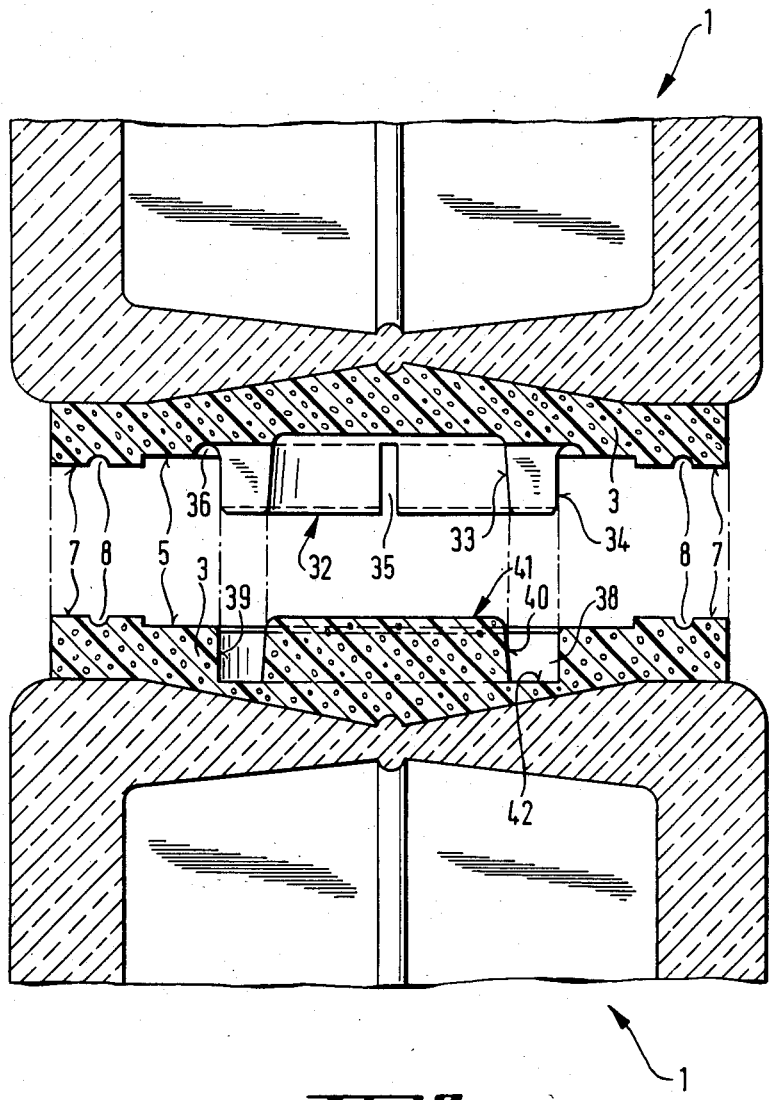
FIG. 7 is a cross-section along the line VII—VII of FIG. 6 in a transition region of two coacting glass modular construction blocks.

It may optionally be desirable to obtain a particularly good anchoring of the glass modular building blocks with the aid of the connecting elements. An embodiment of the novel glass modular building block fulfilling these conditions is shown in FIGS. 6 and 7. In this case, the securing projections on the peripheral surfaces 5 are implemented by way of circular hollow cylinders 32. The inner wall surface 33 is formed so as to be slightly conical, by the diameter increasing in an outward direction. The outer wall surface 34 has a cylindrical form. By the radially extending slits 36 the hollow cylinders are subdivided into four segments, as a result of which they are provided with required elasticity. The hollow groove 36 at the foot of the hollow cylinder 32 further contributes to the increase of the elasticity.

The recess provided for receiving the hollow cylinder 32 in the frame of the adjoining glass modular building block is correspondingly shaped in the form of an annular channel 38. The outer bordering surface 39 of the annular channel is cylindrically formed. The inner bordering surface 40 of the annular channel 38 has a slightly conical form and forms the mantle surface of a conically formed body 41. The body 41 serves as a spreading cone for the segments of the hollow cylinder 32.

The glass modular building blocks are assembled by hammering strokes. In this process the segments of the hollow cylinder 32 are spread apart by the spreading cone 41. The spreading is largest at the rim of the hollow cylinder 32. Consequently a certain anchoring of the hollow cylinder wall takes place at the wall 39 of the annular channel in the neighborhood of the base surface 42 of the annular channel 38, so that the force is initiated in the frame 3 at a location which is most favorable from a point of view of rigidity.

The conicity of the cone 41, and of the hollow conical metal surface 33 of the sleeve 32 is relatively small. Good results are obtained if the angular inclination of the mantle line of the cone 41 is 4 to 8 degrees, and preferably about 5 degrees. Under these conditions the connection following assembly is selflocking, so that any undesirable release of the connection cannot take place. Within the annular channel 38, the cone 41 can, in turn, also be implemented as a hollow cone, by being merely formed as a ring. In this manner, on one hand material can be saved, and on the other hand a certain elasticity can be imparted to this cone, which may be advantageous in view of possible manufacturing tolerances.

Figure 8:
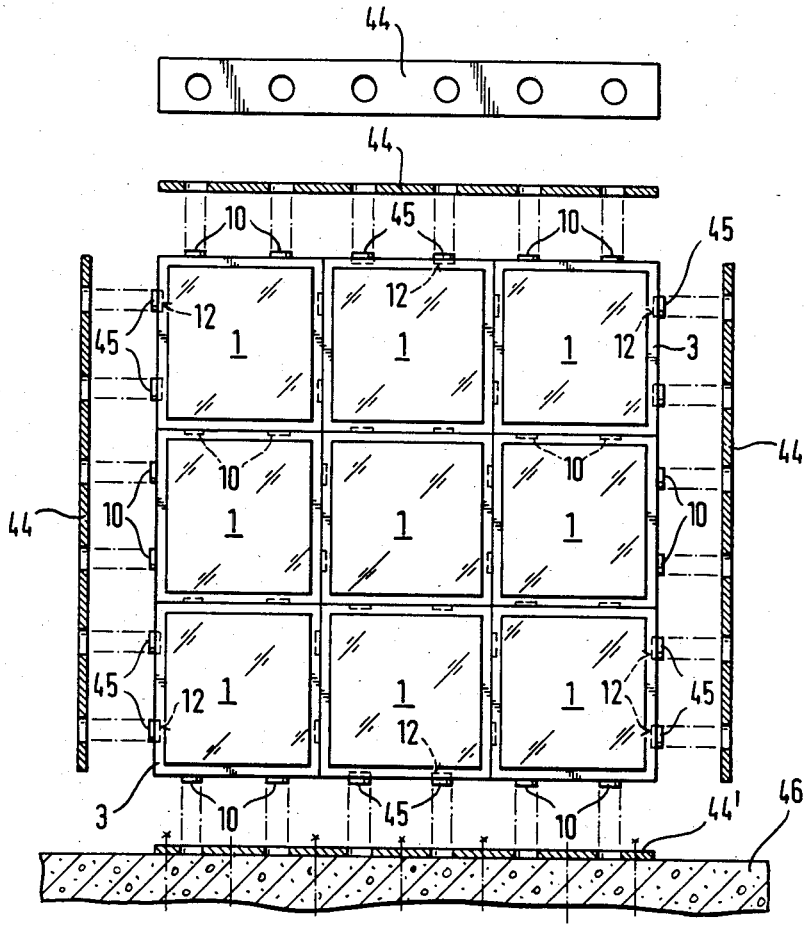
FIG. 8 is an inventively constructed wall portion.

Another method for increasing the rigidity or cohesion of a wall portion assembled from the glass modular building blocks, according to the invention, is shown in FIG. 8. According to this feature, perforated ledges 44 may consist of metal or of synthetic material, and may be cut at the building location to the desired length. The perforated ledges 44 are slid onto the projections 10. To the extent that the glass modular building blocks do not have any projections, but only recesses 12 on that side, connecting blocks 45 are inserted into recesses 12, which take over the role of the projections at these locations.

During assembly of the wall portion, for example in an initial rough opening of a building, a perforated ledge 44' is at first secured, for example with the aid of dowels, onto the cement support or masonry support 46 at a length corresponding to the width of the wall portions. Subsequently cylindrically-formed connecting blocks 45 are inserted on the underside of the lowermostglass modular building blocks into the recesses, and the lowermost row of the glass modular building blocks is secured to the connecting projections 10, or to the connecting plugs 45 on the perforated ledge 44'. After the wall portion has been assembled to the desired size, connecting plugs 45 are also inserted into the recesses of the frame on the lateral portions of the wall part and on its upper bordering surfaces, and subsequently perforated leges 44 are slid over the connecting projections 10, or over the connecting plugs 45. Any gaps remaining up to the masonry opening are then closed in the usual manner, for example by mortar, or by injection with a synthetic material or synthetic foam material.

I claim:

1. A glass construction block comprising a glass modular element, a frame having an outer peripheral surface and two side surfaces, said frame surrounding said glass modular element, said outer peripheral surface having cylindrically shaped recesses and projections adapted for being plugged into frictional engagement with a similar and adjoining glass construction block, said frame comprising shoulders extending outwardly near each side surface, and being adapted to abut the shoulders of said adjoining glass construction block, each shoulder including two longitudinal ledge-like embossments, and a groove formed between said embossments, a space between the shoulders, adapted for the insertion of a reinforcement bar, said frame being made of a synthetic material having a D Shore hardness from 70 to 85.

2. The glass construction block of claim 1 further comprising a bore in said frame, said bore communicating with said groove, whereby a sealing mass may be introduced into said groove through said bore.

3. The glass construction block as claimed in claim 1, wherein said synthetic material is a thermoplastic material.

4. The glass construction block as claimed in claim 1, wherein said frame has material-saving clearances between said shoulders.

5. The glass construction block as claimed in claim 1, wherein said peripheral surface includes pairs of oppositely disposed sides, and wherein the sides of each pair are each formed with a longitudinally extending slit adapted to receive a tension wire, whereby a plurality of adjoining glass construction blocks can be held together when said tension wire is passed through said slits so as to surround said blocks, and upon said tension wire being thereafter put under tension.

6. The glass construction block as claimed in claim 5, wherein said hard polyurethane integral foam has a bending E modulus of about 1050 MPa, a compression rigidity of 12 mPa at a 10% compression, and a linear thermal expansion coefficient of 90 m/m. $K.10^6$, at a form-foamed density of 600 $kg/m^3$.

7. The glass construction block as claimed in claim 1, wherein said frame is made of hard polyurethane integral foam having a foamed core and an unfoamed covering layer.

8. The glass construction block as claimed in claim 1, wherein said peripheral surface normally has a certain size, and wherein said certain size is enlarged by at least a factor of two by corrugation, burling or roughening of said peripheral surface, whereby adhesion between said glass modular element and said frame is increased.

9. The glass construction block as claimed in claim 1, wherein each projection includes a ring-shaped hollow cylinder, and each recess includes a ring-shaped groove having an outer wall, and further including a cone surrounded by said ring-shaped groove, and converging slightly in an outward direction, and wherein said cone is adapted to press the corresponding ring-shaped hollow cylinder of the adjoining glass construction block against the outer wall of said ring-shaped groove.

10. The glass construction block as claimed in claim 9, wherein each ring-shaped hollow cylinder has an axis, and is provided with slits extending in a direction parallel to said axis.

11. The glass construction block as claimed in claim 9, wherein each ring-shaped hollow cylinder has an inner surface which defines an outer surface of an imaginary truncated cone diverging slightly in an outward direction.

12. The glass construction block as claimed in claim 11, wherein the conicities of said cone, and of said inner surface of said ring-shaped hollow cylinder are so chosen as to result in an automatic braking action when said cone engages the corresponding inner surface of the adjoining glass construction block.

13. The glass construction block as claimed in claim 10, wherein said slits extend in a radial direction.

14. The glass construction block as claimed in claim 10, wherein each ring-shaped channel, each ring-shaped hollow cylinder, and each cone has a substantially circular cross-section.

* * * * *